United States Patent [19]

Pope, Jr. et al.

[11] 4,301,799

[45] Nov. 24, 1981

[54] NON-COLLAPSIBLE MEDICAL FLUID CONTAINER WITH AIR VENT FILTER

[75] Inventors: J. Lee Pope, Jr., Baltimore, Md.; James W. Scott, Lindenhurst, Ill.

[73] Assignee: Baxter Travenol Laboratories, Inc., Deerfield, Ill.

[21] Appl. No.: 89,600

[22] Filed: Oct. 29, 1979

[51] Int. Cl.[3] ..... A61J 1/00

[52] U.S. Cl. ..... 128/272; 128/214 R; 222/189

[58] Field of Search ..... 55/528, 279; 215/240; 128/272, 207.23, 207.24, 207.25, 214 R, 213 R, 214 C, 214.2, 227; 222/478, 189

[56] References Cited

U.S. PATENT DOCUMENTS

| | | | |
|---|---|---|---|
| 2,191,447 | 2/1940 | Beardsley | 215/248 |
| 2,585,938 | 2/1952 | Jordan | 128/272 |
| 2,605,021 | 7/1952 | Churchill et al. | 222/478 |
| 3,063,904 | 11/1962 | Ryan | 128/214.2 |
| 3,330,281 | 7/1967 | Visser | 128/272 |
| 4,193,399 | 3/1980 | Robinson | 55/159 |

*Primary Examiner*—Robert W. Michell
*Assistant Examiner*—J. L. Kruter
*Attorney, Agent, or Firm*—Paul C. Flattery; John P. Kirby, Jr.; Gary W. McFarron

[57] ABSTRACT

A non-collapsible medical fluid container is disclosed, with microporous filter means mounted on the interior end of a vent conduit that extends into the container for venting displacement air thereinto. The filter means, preferably a rigid microporous depth-type filter frictionally mounted on the end of the vent conduit, is mounted closely adjacent to an interior surface of the container to prevent dislodgement of the filter by pressure from the venting air.

16 Claims, 3 Drawing Figures

NON-COLLAPSIBLE MEDICAL FLUID CONTAINER WITH AIR VENT FILTER

The present invention generally relates to containers for medical fluids such as parenteral solutions and the like. More particularly, it relates to non-collapsible medical fluid containers which require the venting of displacement air into the container for discharge of the liquid contained therein.

Medical fluids for administration to a patient, for example parenteral solutions, are often sold in rigid containers, such as glass bottles. During production, the empty head space in such containers is usually evacuated, and the container is hermetically sealed to maintain sterility until it is used. One example of such a container and the closure for it is illustrated in U.S. Pat. No. 3,904,059 to Bellamy, Jr. et al. The closure system shown there employs a solid rubber stopper mounted within the open neck of the container. The stopper includes at least two ports, one in which an air vent tube is positioned and another for receiving the end of an administration set when the fluid is administered to a patient. A latex disc, held in place by a combination sealing ring and overcap, seals the open ports of the rubber stopper. When the parenteral fluid is to be administered, the metal overcaps are removed and the latex disc pulled from the rubber stopper. Because the container is packaged under vacuum, removal of the latex disc causes an immediate surge of air through the vent tube into the container. The container is then inverted for discharge of the fluid to a patient, and displacement air to replace the discharging liquid is vented into the container through the vent tube, which extends above the liquid level. Typically, the air venting into the container is from the ambient atmosphere, a possible source for contamination. To preserve complete sterility of the fluid it is desirable that the displacement air be filtered as it enters the container. Heretofore, however, there has been no simple, effective filtration system which is easy to manufacture at low cost, and capable of being incorporated into existing products without substantial changes in the product or manufacturing tooling.

Accordingly, it is a general object of the present invention to provide means for filtering displacement air which is vented into the container to permit discharge of liquid therein.

It is a further object of the present invention to provide filter means in combination with the vent tube which is easy to assemble, at relatively low cost.

It is a still further object of the present invention to prove a filter which may be attached to the end of the air vent tube and does not dislodge upon the initial surge of venting air into the container when the container cap is removed.

These and other objects of the present invention are set forth in the following detailed description of the attached drawings of which:

Figure 1:
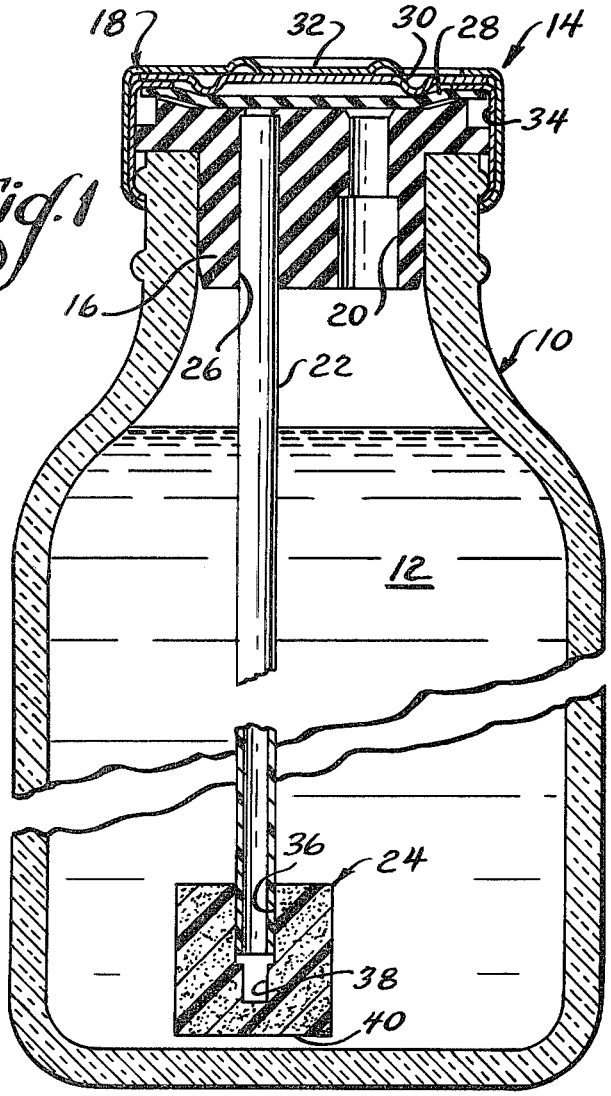
FIG. 1 is a vertical sectional view, partially foreshortened, illustrating a non-collapsible medical fluid container embodying the present invention for filtering displacement air which enters the container.
Figure 2:
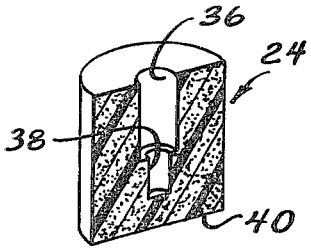
FIG. 2 is a perspective view of the filter employed in the present invention for attachment to the container vent tube to filter venting air.

The present invention is generally embodied in a non-collapsible medical fluid container, such as the glass bottle illustrated at 10, holding a supply of medical fluid, for example a parenteral solution 12. Closure means 14 comprising a rubber stopper 16 and overcap combination 18 close the open neck of the glass bottle. Discharge of the parenteral solution 12 is accomplished by inverting the container so that the solution flows, as by gravity, through an opening or port 20 in the stopper.

For continuous discharge of fluid from the container 10, displacement air must be vented into the container to replace the liquid that is draining out. In accordance with the present invention, the displacement air is admitted into the bottle through vent conduit means in the form of an upstanding vent tube 22, which carries microporous filter means 24 at the interior end of the vent tube. The filter means is preferably a porous depth-type filter frictionally mounted on the end of the vent tube, closely adjacent the inside surface of the container so that the filter does not dislodge from the end of the tube upon the initial high pressure surge of air into the container when it is opened.

Turning now to a more detailed description of the preferred embodiment of the present invention which is shown in the attached drawings for the purpose of illustration and not limitation, the non-collapsible container illustrated in the attached drawings is a glass bottle, although it could also be of relatively rigid plastic material. By "non-collapsible" in the present invention it is intended to include any medical fluid container which requires the venting of displacement air into the container for liquid discharge, and thus is not limited to a rigid glass or plastic container.

The top of the glass bottle 10 has an open neck, with closure means 14 to seal the neck in a sterile fashion until it is ready to use. The details of the closure construction shown in the application are set forth more fully in U.S. Pat. No. 3,904,059 to Bellamy, Jr. et al. Briefly, the closure means 14 includes a resilient rubber stopper 16 tightly positioned within the container neck. The stopper has at least two cylindrical ports or opening 20 and 26, which extend completely through the stopper and open to the exterior. Respectively, ports 20 and 26 permit liquid to be discharged from the container and displacement air to vent into the container. To preserve the sterility of the parenteral solution 12, a latex disc 28 covers the stopper and is held in intimate contact with the surface thereof by an inner depression ring 30 and an outer cap portion 32 which are removed to open the container. A further, removable inner ring 34 engages the peripheral edge of the latex disc and holds it in place against the rubber stopper.

Normally the parenteral solution 12 is packaged and the closure 14 added while the solution is under vacuum. After removal of the outer cap and depression ring, the presence of this vacuum may be verified by slight depressions in the latex disc overlying the openings 20 and 26 in the rubber stopper. Upon removal of the latex disc, there is an initial rush of displacement air into the container because of the vacuum created therein during packaging. This rush of air may create a pressure up to about 13 psi.

To admit displacement air into the container 10 without loss of parenteral solution when the container is inverted, an elongated generally cylindrical vent tube 22 is frictionally fit into the opening 26 of the stopper and extends into the container, to a position that will be above the fluid level when the container is inverted.

In accordance with one aspect of the present invention, displacement air that passes through the vent tube is filtered through microporous filter means 24 carried on the end of the vent tube. In the preferred embodiment the filter means is a cylindrically shaped, microporous depth-type filter. This type of filter may have relatively large pore sizes, but the tortuous passageway through which the venting air must pass removes any particulate or foreign matter, and, depending on the pore size and length of tortuous passageway, may even remove some types of bacteria. Preferably the depth filter is made of a plastic compatible with the medical solution 12. One preferred filter material is sintered polyethylene, which is naturally water-repellent or hydrophobic, available under the trademark "POREX" from Glasrock Products, Inc. of Atlanta, Ga.

The nature of this particular material, and its use as a filter for liquid reagents, is set forth in U.S. Pat. No. 3,774,640. Additionally, sintered polyethylene from Glasrock has been used as a bubble generator in a medical humidifier, i.e., air is forced through a submerged sintered polyethylene element, which disperses the air and allows it to bubble upwardly through the liquid for humidification; to vent air from a blood flashback chamber in a catheter, for example, U.S. patent application Ser. No. 813,890, filed July 8, 1977 now U.S. Pat. No. 4,193,399; and an extremely large pore size sintered polyethylene filter plug has also been used as a serum blood filter.

In the present invention, the depth filter 24 has a pair of cylindrical bores 36 and 38 of differing diameters which extend axially into the cylindrical depth filter, and define a shoulder between the respective bores for abutting the end of the vent tube 22. Sintered polyethylene is slightly resilient which permits simple but tight frictional engagement between the surface of the bore 36, which is made with a slightly smaller diameter than the vent tube. Air venting through the vent tube, enters the filter, the smaller bore beyond the end of the vent tube providing a larger interior surface of the filter for the air to pass through.

The length of the filter 24 may be varied, but in accordance with another aspect of the present invention, the length is such that the bottom edge or end 40 of the filter either rests against the bottom surface of the container 10 or is sufficiently close to it that the filter does not dislodge from the vent tube when the syringe of higher pressure displacement air occurs as the container is opened. In other words, the length of vent tube inserted into the bore 36 should be greater than the width of any gap between filter surface 40 and the bottom of the container. Should in-rushing air force the filter against the bottle bottom, the vent tube will still be positioned within the bore 36, assuring that all venting air will be filtered. This arrangement permits the filter to be attached to the end of the tube using a simple frictional engagement, without the need for adhesives or special bonding techniques. This is particularly advantageous as it allows immediate use or implementation of the invention on standard and available products, without the need for substantial production changes, redesign or retooling.

Figure 3:
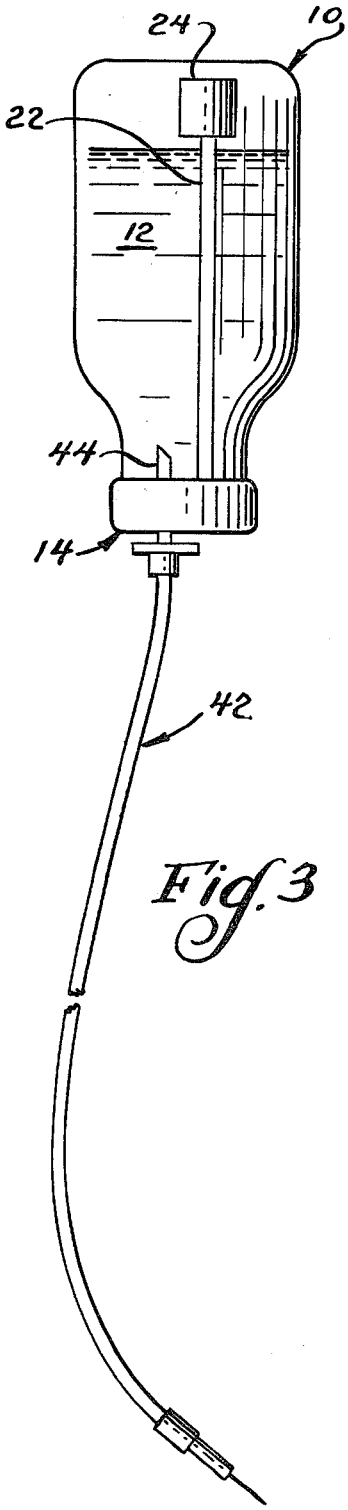
FIG. 3 is an elevation view of a medical fluid container embodying the present invention as it is used during administration of the medical fluid to a patient.

As shown in FIG. 3, a container in accordance with the present invention is used in an inverted position to discharge the medical fluid for infusion to a patient. Typically, an administration set 42 with an end spike 44 is inserted into the opening 20 of the rubber stopper for the passage of liquid to the patient. Displacement air enters the container through opening 26 in the stopper, passing upwardly through the vent tube 22 and through the rigid microporous depth-type filter 24, which is normally above the liquid level when the container is inverted. It has been found that a cylindrical depth filter of the material described, which has a length of about 1½ inches and a pore size of less than or equal to about 20 microns permits both prompt initial venting displacement air into the container as well as continued venting during an administration without retarding the discharge of liquid from the container. The hydrophobic or liquid-repellent nature of the preferred material, sintered polyethylene, also prevents the parenteral solution 12 from wetting and blocking the pores of the filter. Thus, the filter is effective even when submerged beneath the liquid, e.g., during initial opening.

Although the present invention has been described in terms of the preferred embodiment, the invention as set forth in the following claims, is intended to cover those equivalent structures, some of which may be obvious upon initial reading of this application and others of which may be obvious only after some study.

What is claimed is:

1. In a non-collapsible medical fluid container comprising a supply of medical fluid therein, opening means at one end of the container for discharge of the fluid by inversion of the container, and a displacement air vent conduit extending from said opening means into the container and terminating at a location spaced from the other end of said container to vent air thereinto to permit liquid discharge, the improvement comprising:

microporous filter means biologically compatible with said medical fluid, said filter means being frictionally received over the terminal end portion of said vent conduit and spaced from the interior surface of said other end of said container, the length of said terminal end portion received within said filter means being greater than the distance between said filter means and said interior surface at said other end of the container, whereby the filter means cannot completely dislodge from the end of the conduit by pressure from the venting air.

2. A medical fluid container in accordance with claim 1 wherein said microporous filter means comprises a rigid microporous depth filter with a pore size sufficiently large to vent the desired quantity of displacement air into the container but with sufficiently tortuous passageways to filter the venting air adequately.

3. Medical fluid container in accordance with claim 2 wherein said depth filter is made of hydrophobic plastic material.

4. Medical fluid container in accordance with claim 3 wherein said plastic material is sintered polyethylene.

5. A medical fluid container in accordance with claim 4 wherein the pore size is not greater than 20 microns.

6. A medical fluid container in accordance with claim 1 wherein said vent conduit is generally tubular shaped, and said microporous filter means is frictionally fit over the end of the conduit.

7. A medical fluid container in accordance with claim 6 wherein said microporous filter means comprises a rigid microporous depth filter, said filter including a bore-shaped recess therein for frictionally receiving the interior end of said tubular shaped conduit.

8. A medical fluid container in accordance with claim 7 wherein said depth filter includes a second, smaller diameter bore-shaped recess axially aligned with the first mentioned recess and defining a shoulder therebetween for abutting the end of said tubular conduit.

9. A medical fluid container in accordance with claim 8 wherein the depth filter is generally cylindrically shaped, with a pore size not greater than 20 microns and a length not less than $1\frac{1}{2}$ inches.

10. A medical fluid container in accordance with claim 1 wherein said vent conduit is of sufficient length that said filter is above the liquid level when the container is inverted.

11. In a non-collapsible medical fluid container of the type adapted to be emptied by inverting the container to discharge the fluid through closure means normally closing the top of the container and including a displacement air vent tube extending from the closure means toward the bottom of the container for venting displacement air into the container during liquid discharge, the improvement comprising a rigid microporous depth filter carried on the lower end of said vent tube and including a cylindrical bore-shaped recess therein for receiving said lower end of said tube, said depth filter having a surface portion closely spaced relative to the interior surface of the bottom wall of the container, the length of said bore-shaped recess being greater than the distance between said surface portion and said interior surface to prevent dislodgement of the filter from the tube during venting.

12. A medical fluid container in accordance with claim 11 wherein said lower end of said tube is frictionally fit into said bore-shaped recess.

13. A medical fluid container in accordance with claim 11 wherein the filter includes a pair of axially aligned bore-shaped recesses of different diameters to define a shoulder therebetween for abutment by the end of said tube.

14. A medical fluid container in accordance with claim 13 wherein said filter is generally cylindrically shaped, said bore-shaped recess being axially positioned therewithin, and said filter having a pore size not greater than 20 microns.

15. A medical fluid container in accordance with claim 13 wherein the filter has a length of about $1\frac{1}{2}$ inches.

16. A medical fluid container in accordance with claim 11 wherein said tube of sufficient length to position the depth filter above the liquid level when the container is inverted.

* * * * *